US008002360B2

(12) United States Patent
Cochran et al.

(10) Patent No.: US 8,002,360 B2
(45) Date of Patent: Aug. 23, 2011

(54) ADJUSTABLE PLANER SYSTEM

(75) Inventors: Gary Cochran, Colwich, KS (US); Dennis Skraba, Irmo, SC (US)

(73) Assignee: Coneqtec Corp., Wichita, KS (US)

( * ) Notice: Subject to any disclaimer, the term of this patent is extended or adjusted under 35 U.S.C. 154(b) by 212 days.

(21) Appl. No.: 12/401,922

(22) Filed: Mar. 11, 2009

(65) Prior Publication Data

US 2009/0232598 A1 Sep. 17, 2009

Related U.S. Application Data

(60) Provisional application No. 61/035,560, filed on Mar. 11, 2008.

(51) Int. Cl.
*E21C 25/06* (2006.01)
*E01C 23/12* (2006.01)

(52) U.S. Cl. ..... 299/39.6; 299/39.4

(58) Field of Classification Search ..... 299/39.6, 299/39.4

See application file for complete search history.

(56) References Cited

U.S. PATENT DOCUMENTS 4,103,973 A * 8/1978 Cutler ..... 299/39.6
4,878,713 A * 11/1989 Zanetis ..... 299/39.5
4,938,537 A * 7/1990 Rife et al. ..... 299/39.6
5,354,147 A * 10/1994 Swisher, Jr. ..... 299/39.6
5,378,081 A * 1/1995 Swisher, Jr. ..... 299/39.6
5,474,397 A * 12/1995 Lyons ..... 299/39.6
5,893,677 A * 4/1999 Haehn et al. ..... 299/39.6
6,227,620 B1 * 5/2001 Page ..... 299/39.4
6,247,757 B1 * 6/2001 Cochran ..... 299/39.6
7,004,675 B2 * 2/2006 Wayne ..... 299/39.6
7,029,370 B2 * 4/2006 Cochran et al. ..... 299/39.6
7,325,881 B2 * 2/2008 Cochran et al. ..... 299/39.6
2003/0127905 A1 * 7/2003 Haroldsen et al. ..... 299/39.6

OTHER PUBLICATIONS

International Search Report and Written Opinion of PCT/US2009/036759 dated Oct. 15, 2009.

* cited by examiner

*Primary Examiner* — Frederick L Lagman
(74) *Attorney, Agent, or Firm* — Woodard, Emhardt, Moriaty, McNett & Henry LLP

(57) ABSTRACT

Certain embodiments of the disclosure include planers with side plates which may be adjusted independently or simultaneously. In a preferred embodiment of the present invention, a planer with adjustable side plates is comprised of a planer housing enclosing a grinding drum with grinding tools to be moved over a surface to be ground in a direction of travel and a pair of side plates are arranged substantially parallel to the direction of travel and mounted substantially adjacent the housing. The side plates are mechanically linked to the housing and are hydraulically controlled to be adjustably raised and lowered relative to the housing.

19 Claims, 7 Drawing Sheets

ADJUSTABLE PLANER SYSTEM

This application claims the benefit of provisional application Ser. No. 61/035,560 filed on Mar. 11, 2008.

FIELD OF THE INVENTION

The disclosed embodiments relate to cold planer grinding systems for surfaces such as roadways. It is described in the context of a system that is added to prime movers, such as skid-steer loaders, but is believed to be useful in other applications as well.

BACKGROUND

In normal use, a skid-steer loader has a loader bucket pivotally attached to two front lift arms. Optionally, the loader bucket of a skid-steer loader may be removed and alternate or auxiliary implements such as a cold planer may be attached to grind hard surfaces such as road surfaces of concrete or asphalt. In some embodiments it is desirable for the planer to have side plates to minimize the projection of cut material or debris from the grinding portions. In certain uses, it is desirable to have adjustable side plates to adjustably control the cutting depth, to minimize the discharge of debris during use and to maintain a desired cutting alignment. Adjustable side plates also allow for compensation to maintain the side plates in close alignment with the surface when and/or if the support vehicle alignment changes. In certain embodiments it may be desirable for the side plates to automatically compensate to maintain a close alignment with the surface when the planer grinding depth is adjusted.

Certain embodiments of the present invention address these issues.

SUMMARY

In certain embodiments, a planer is based on a grinding drum with grinding tools or teeth mounted within a shield or shell which is typically level or angled and configured to move at a uniform height along or above a surface. The planer machine may be mounted on a host machine, such as via a frame to a skid-steer loader, or it may operate independently, for example when mounted to an independent frame or trolley.

Certain embodiments of the disclosure include planers with side plates which may be adjusted independently or simultaneously. In a preferred embodiment of the present invention, a planer with adjustable side plates is comprised of a planer housing enclosing a grinding drum with grinding tools to be moved over a surface to be ground in a direction of travel and a pair of side plates are arranged substantially parallel to the direction of travel and mounted substantially adjacent the housing. The side plates are mechanically linked to the housing and are hydraulically controlled to be adjustably raised and lowered relative to the housing.

A method according to the present disclosure involves grinding a surface with a planer. An example preferred method provides a hydraulic grinding assembly mounted on a frame with adjustable side plates. The side plates are selectively independently or jointly adjusted to support the grinding assembly at a desired height above the surface to be ground as the grinding assembly is moved in the direction of travel. Preferably the raising and lowering of the side plates is hydraulically controlled.

It is an object of certain preferred embodiments of the present invention to provide an improved planer system.

Other objects and advantages shall become clear from the enclosed drawings and descriptions.

DESCRIPTION OF THE ILLUSTRATED EMBODIMENTS

Figure 1:
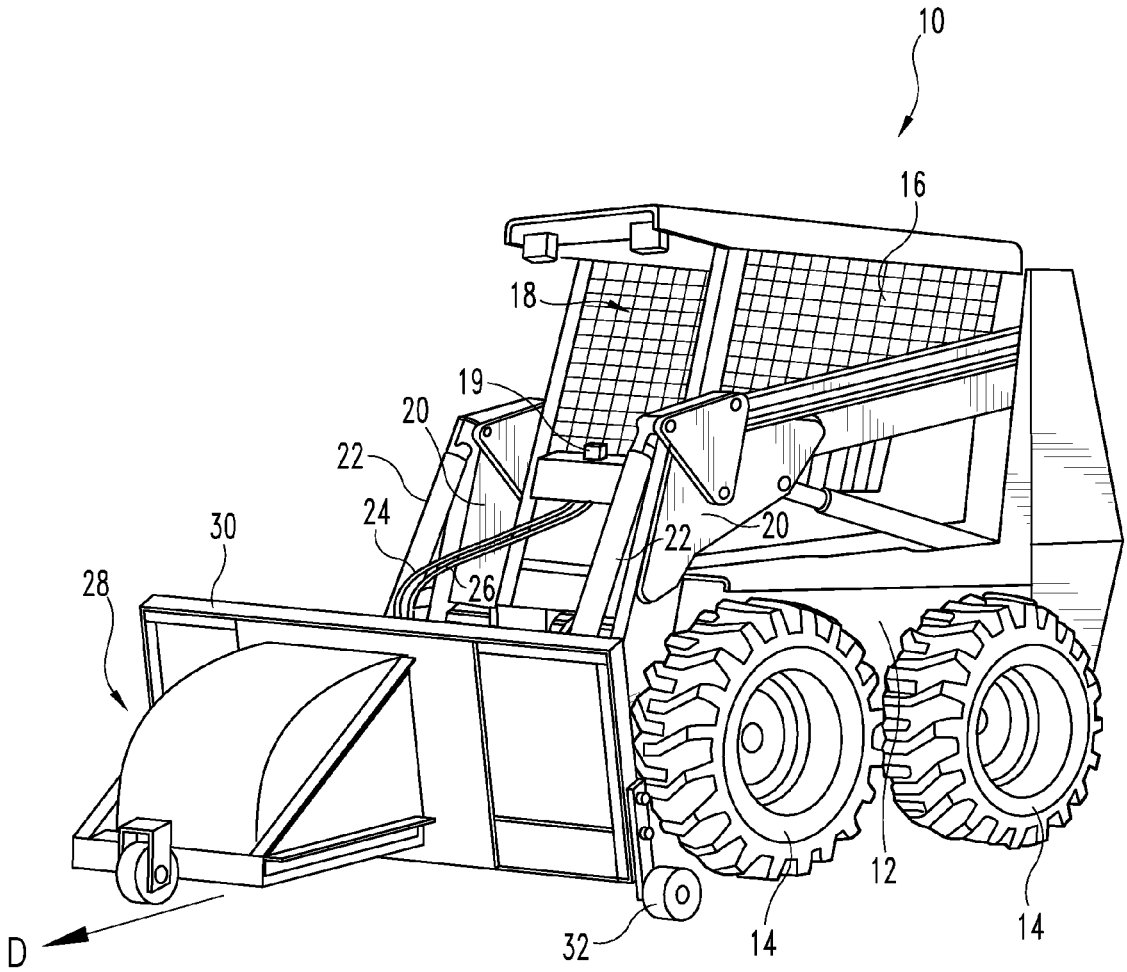
Fig. 1 (PRIOR ART)
FIG. 1 is a perspective view of a skid steer loader and an example prior art planer implement.

For the purposes of promoting an understanding of the principles of the disclosure, reference will now be made to the embodiment illustrated in the drawings and specific language will be used to describe the same. It will nevertheless be understood that no limitation of the scope of the claims is thereby intended, such alterations and further modifications in the illustrated device, and such further applications of the principles of the disclosure as illustrated therein, being contemplated as would normally occur to one skilled in the art to which the disclosure relates.

Referring generally to FIG. 1 there is shown a skid steer loader as an example support vehicle with a prior art planer. A typical skid steer loader 10 is a type of support vehicle having a frame 12, four wheels 14 or tracks, an operator position, such as a cage or cab 16 with a seat 18, and a pair of left and right front lift arms 20. Left and right hydraulic cylinders 22 may be paired with lift arms 20. Various work tool implements may be interchangeably mounted to the skid steer loader, for example by being coupled and uncoupled from the lift arms 20.

As illustrated, an implement frame 30 is generally configured to be mounted to the left and right arms 20 of the skid steer loader and optionally the left and right hydraulic cylinders 22. In a preferred embodiment, brackets are provided at the rear of the frame allowing the frame and planer apparatus 28 to be attached to the lift arms 20 and/or cylinders 22. Left and right arms 20 and the left and right hydraulic cylinders 22 may function in concert to pivot the orientation of frame 30 and the planer. In a preferred embodiment, frame 30 is configured as a lateral piece, which may function as a debris shield and which may allow the planer to be mounted or moved to the left or right of the centerline of the skid-steer loader in the direction of travel D if desired. Optionally ground engaging elements such as rollers 32 are mounted adjacent the foot of the frame 30 to allow the frame to rest upon and roll over a support surface.

The skid-steer loader 10 may have a hydraulic power system, which may be selectively coupled directly or through an interface to certain work implements to provide hydraulic power to the implements. Example supply and return lines 24 are shown. Generally the skid steer loader and any work implements are controlled by an operator through a control 19 located adjacent the operator position. In some skid steer loaders, the operator enters the operator position from the front of the vehicle.

Figure 6:
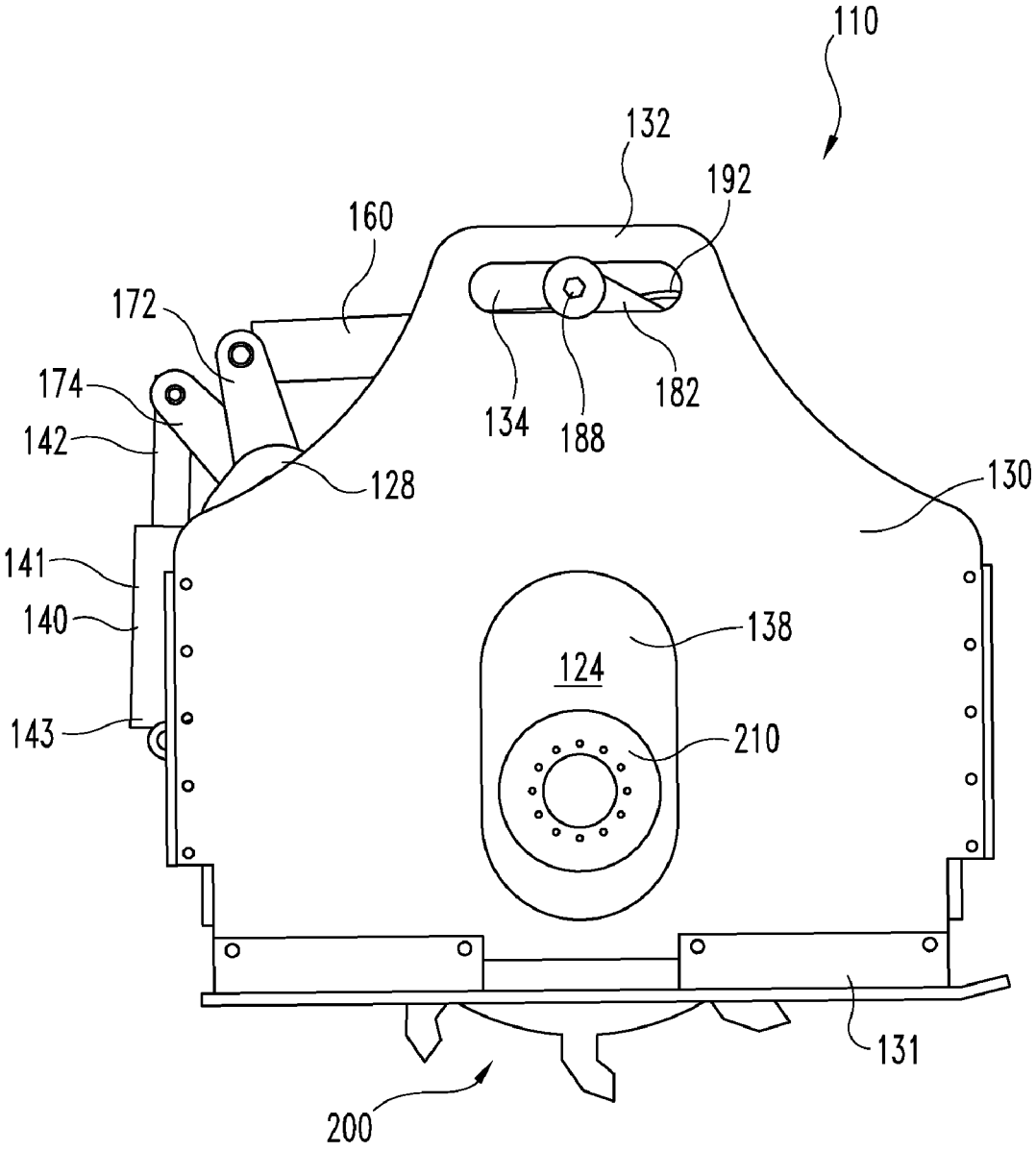
FIG. 6 is a left side view of the planer of FIG. 2 without the frame.
Figure 7:
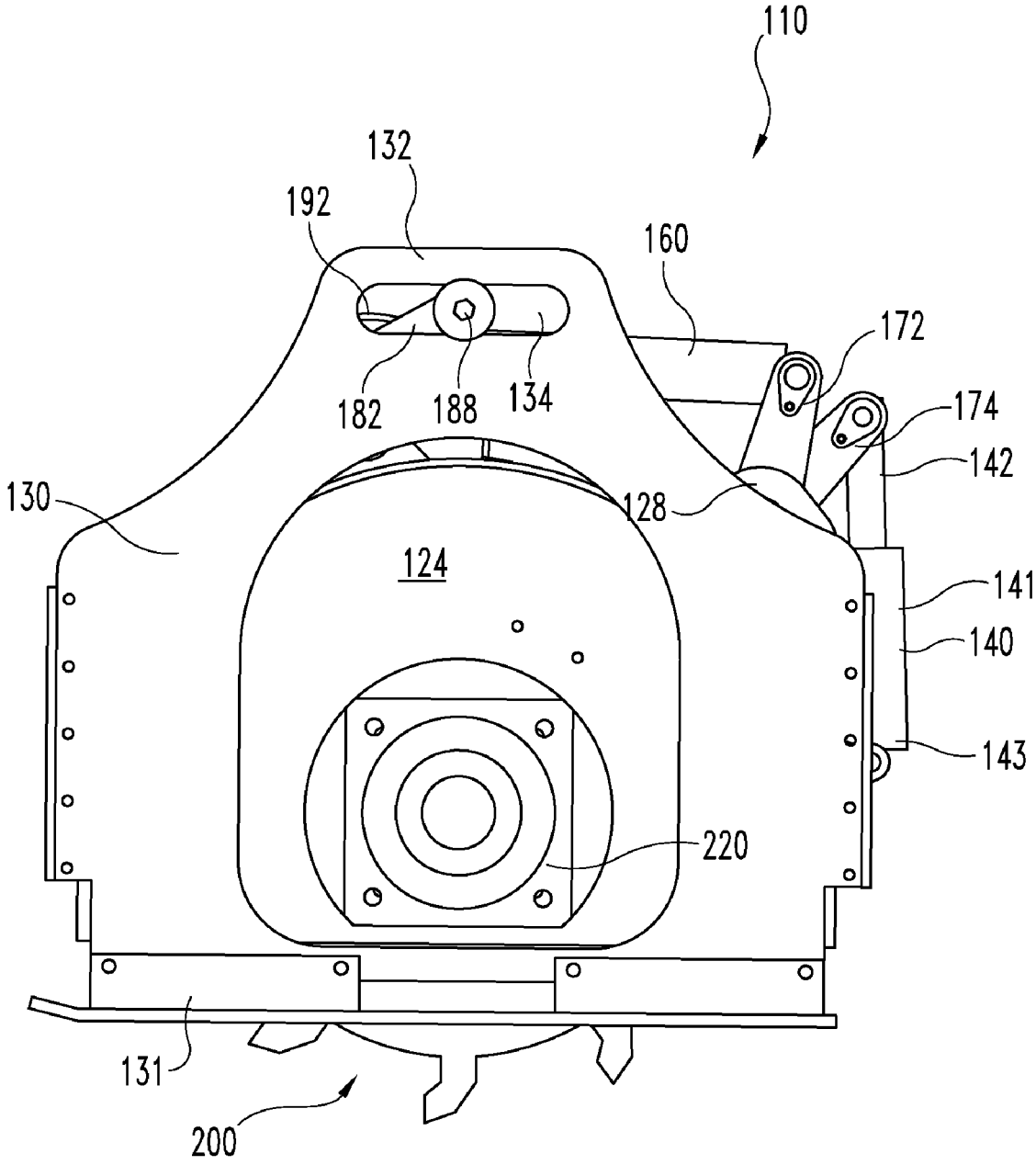
FIG. 7 is a right side view of the planer of FIG. 2 without the frame.

In certain embodiments, a planer is based on a grinding drum with grinding tools or teeth mounted within a shield or shell which is typically level or angled and configured to move at a uniform height along or above a surface. Various conventional grinding drums may be used. For example, a hydraulically driven grinding drum 200 (shown in FIGS. 6-7), with cutting tools or teeth is mounted inside housing 120. Preferably, hydraulic power is supplied to rotate the cutting drum 200 so that the tools or teeth cut into the surface at a desired depth. The grinding drum is hydraulically driven by separate or shared hydraulic lines (not shown).

The planer machine may be mounted on a host machine, such as via a frame to a skid-steer loader, or it may operate independently, for example when mounted to an independent frame or trolley. The support vehicle, frame and/or the side plates are used independently or in cooperation to control the grinding depth of the planer. In certain embodiments, the planer housing is mounted to a support frame which supports the housing at a desired height to control the grinding depth of the grinding drum and which is movable to move the housing and grinding drum along the surface to be ground in the direction of travel. In such arrangements, the side plates may rise above the ground surface if the support frame rises during use, for example in traversing a bump in the ground. In alternate embodiments, the side plates have ground engaging elements to continuously engage and follow contours of the ground to support the housing at a desired height relative to and following the ground. In such embodiments, the frame or host machine may slightly rise and fall in height relative to the housing during use.

Certain embodiments of the disclosure include planers with independently adjustable side plates. Independently adjustable side plates may allow the planer to set and maintain a desired level cut on a non-level surface, to tilt the planer to grind an angled cut with respect to a level or non-level surface or in cooperation with support from a frame, to adjust the side plate heights to provide debris shields at desired heights. In an example arrangement, independently adjustable side plates allow the planer to maintain a level cutting alignment across a broad width when the planer is used in side-by-side cut strips where one side of the cut area is previously cut to a lower depth, and therefore it is desirable for one side plate to be lower than the other.

Figure 2:
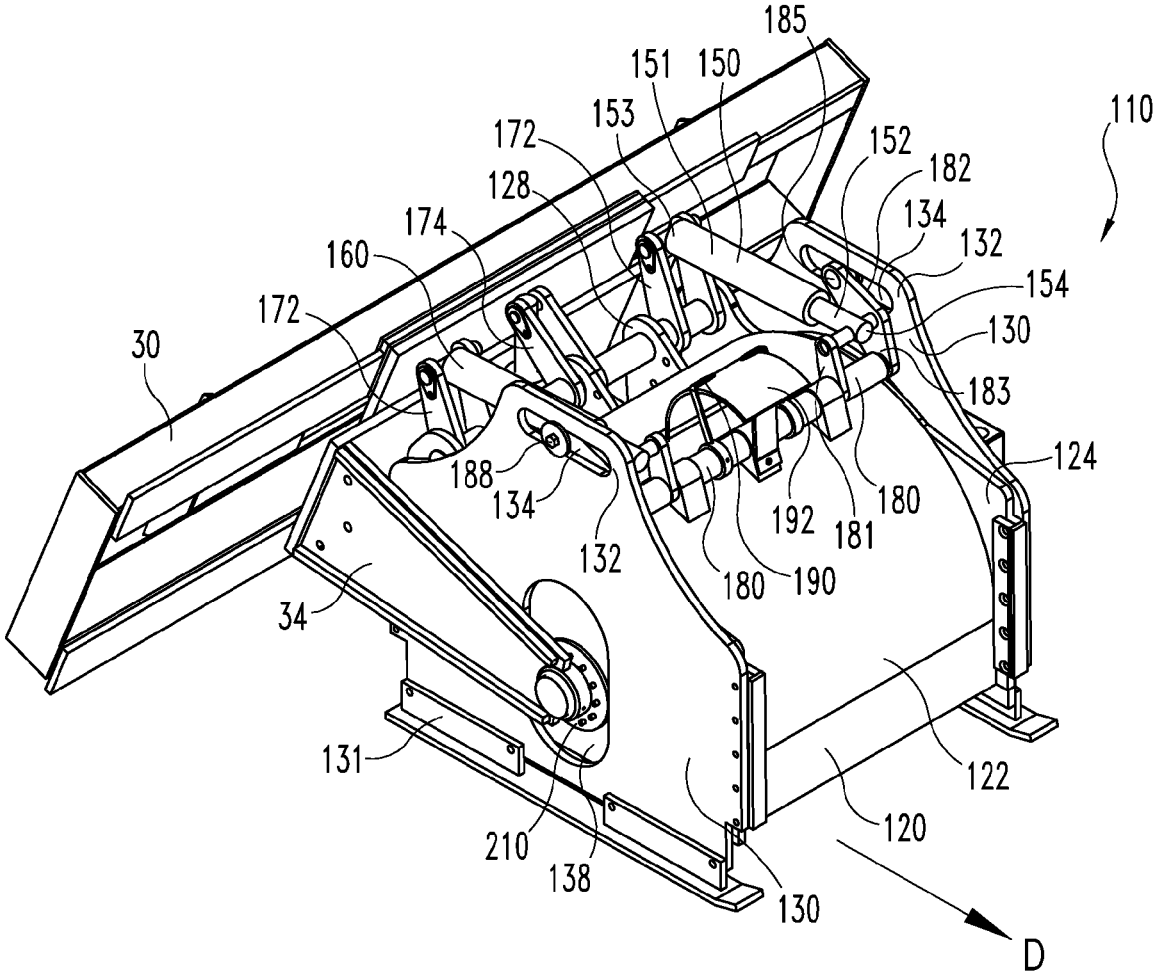
FIGS. 2 and 3 are perspective views of an embodiment of a planer on a frame with adjustable sideplates according to one embodiment.
Figure 3:
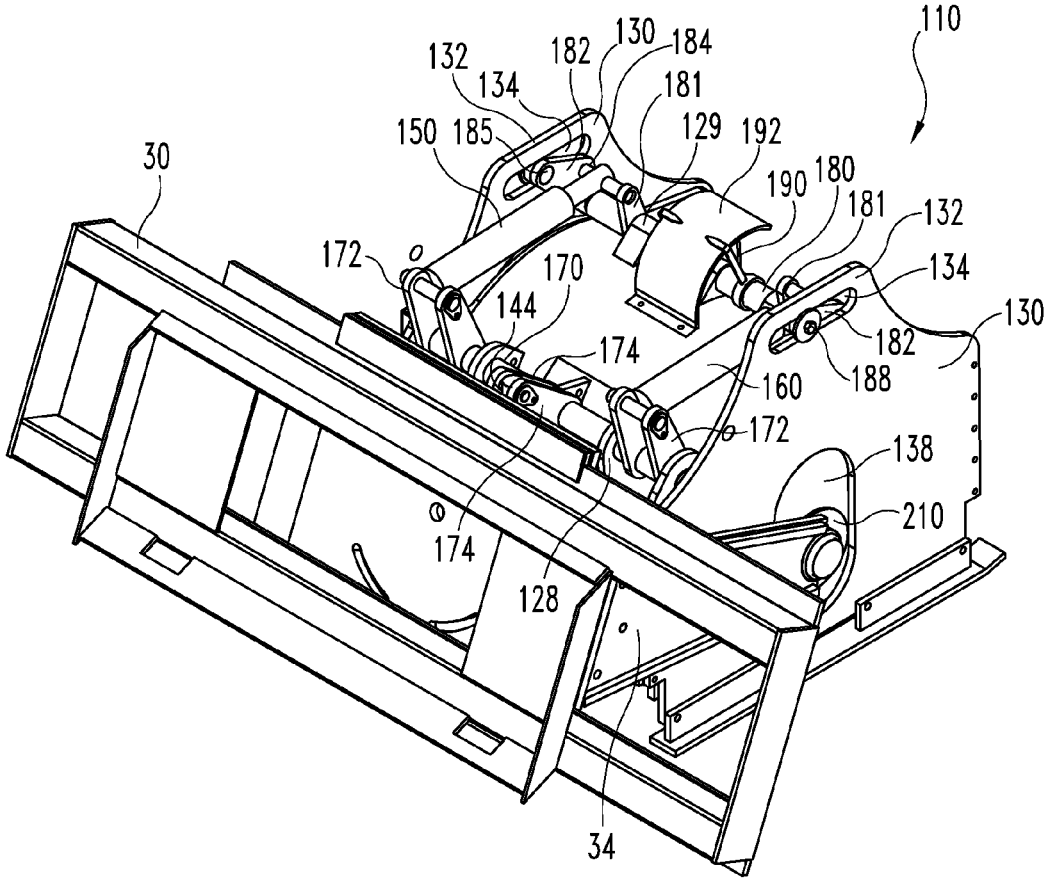

Certain embodiments of the disclosure include planers with side plates which may be adjusted independently or simultaneously. An example embodiment is illustrated in FIGS. 2-7. FIGS. 2 and 3 illustrate a planer 110 mounted to a frame 30 which may be mounted onto a support vehicle, such as skid steer loader 10 of FIG. 1 or onto an independent support. Illustrated planer 110 includes a housing 120 having a rounded shield or shell 122 and a pair of vertical, typically planar, sidewalls 124 arranged substantially parallel to the direction of travel D. Axle openings are defined through the sidewalls of housing 120. A grinding drum assembly is mounted within housing 120 with the rotatable drum aligned along the axis of the axle openings. The grinding drum assembly may be mounted through a bearing hub 210 at one end along the axis of rotation and to a mounting flange 220 at the opposing end. As illustrated, brackets 34 on frame 30 support the grinding drum assembly extending through the axle openings. Hydraulic power is provided to rotate the grinding drum, for example to rotate an end of the axle extending through an axle opening. The grinding drum and power assembly are not illustrated in detail in order to allow a clearer view of the housing and side plate assembly.

As shown in FIGS. 2-7, side plates 130 are mounted to planer 110 parallel to and substantially adjacent sidewalls 124. Side plates 130 are preferably vertical and independently adjustable to be raised and lowered in height relative to sidewalls 124. Ground engaging elements such as an edge, skids 131 or rollers optionally engage the ground to support side plates 130. Side plates 130 include an upper portion 132 with a pin slide slot 134. Grinding axle slots 138 are defined through each side plate. Each axle slot 138 is aligned with an axis of the grinding assembly, and axle slot 138 includes a sufficient size and clearance to allow the side plate to be vertically and horizontally adjusted relative to the sidewall without the side plate, interfering with the bearing hub 210, mounting flange 220, or the operation of the power assembly or the grinding drum.

In the illustrated embodiment, planer 110 allows for independent adjustment of side plates 130 or joint adjustment of both side plates simultaneously. As shown, this is accomplished with a pair of sidewall adjustment hydraulic cylinders 150 and 160 and a joint adjustment cylinder 140. Individual cylinders 150 and 160 are independently controllable to independently adjust a respective side plate 130. Joint cylinder 140 is adjustable and linked to the side plates through cylinders 150 and 160 so that adjustment of cylinder 140 adjusts both side plates 130. Cylinders 140, 150 and 160 are conventional hydraulic cylinders having a housing and a piston, and include conventional hydraulic fluid supply and return lines. The supply and return lines and mountings are not shown for ease of illustration.

Independent cylinder 150 and its linkage arrangements will be discussed in detail. Cylinder 160 and its linkage is arranged in a symmetric manner. As illustrated, cylinder 150 includes a housing 151 with a housing end 153 and a piston 152 with a piston end 154. As will be understood, the orientation of cylinder 150 can be reversed if desired. Housing end 153 is pivotally mounted to an arm pair 172 extending from a common axle 170.

Common axle 170 is mounted to shell 122 through brackets 128. Common axle 170 is preferably able to rotate or pivot along its entire length. Arm pair 172 extends at a fixed angular relationship to common axle 170. A parallel pair of arms 172 pivotally engage cylinder 160. Joint cylinder arms 174 are fixedly mounted to common axle 170, also at a fixed angular relationship, and extend to pivotally engage piston end 144 of joint cylinder 140. Arms 172 and 174 function as offset arms of a bell crank. Preferably the axis of joint cylinder 140 is angularly offset from the axes of side wall adjustment cylinders 150 and 160.

Piston end 154 of cylinder 150 extends and is pivotally linked to a sidewall adjustment bell crank 182 and a parallel bell crank support arm 181 extending from bell crank axle 180. A pair of bell crank axles 180 are mounted to bell crank axle brackets 129 mounted on shell 122 and each is pivotally attached to a bell crank 182. Each bell crank axle 180 extends approximately half the width of the planer 110 and they can pivot independently from each other. Bell crank 182 and corresponding support arm 181 are in a fixed angular relationship to axle 180.

Each bell crank 182 includes an axle connection portion 183, a piston end engagement portion 184 and a sidewall pin engaging portion 185. A bell crank pin 188 extends from sidewall pin engaging portion 185 to engage pin slide opening 134 in the respective sidewall 130. Bell cranks 182 may be formed from single triangular or "L" shaped pieces, but a triangular piece or a single piece is not required so long as the axes of the three connection points are parallel, and form a triangle in a plane to apply force around an angle.

In an optional feature, each bell crank axle 180 may include an angle gauge pin 190 extending at a fixed angular orientation which can be viewed against a gauge plate 192 so that an operator may judge the angle of adjustment of the associated bell crank and side plate. Gauge plate 192 may be plain or marked with indicia to indicate the relative angle of adjustment.

Figure 4:
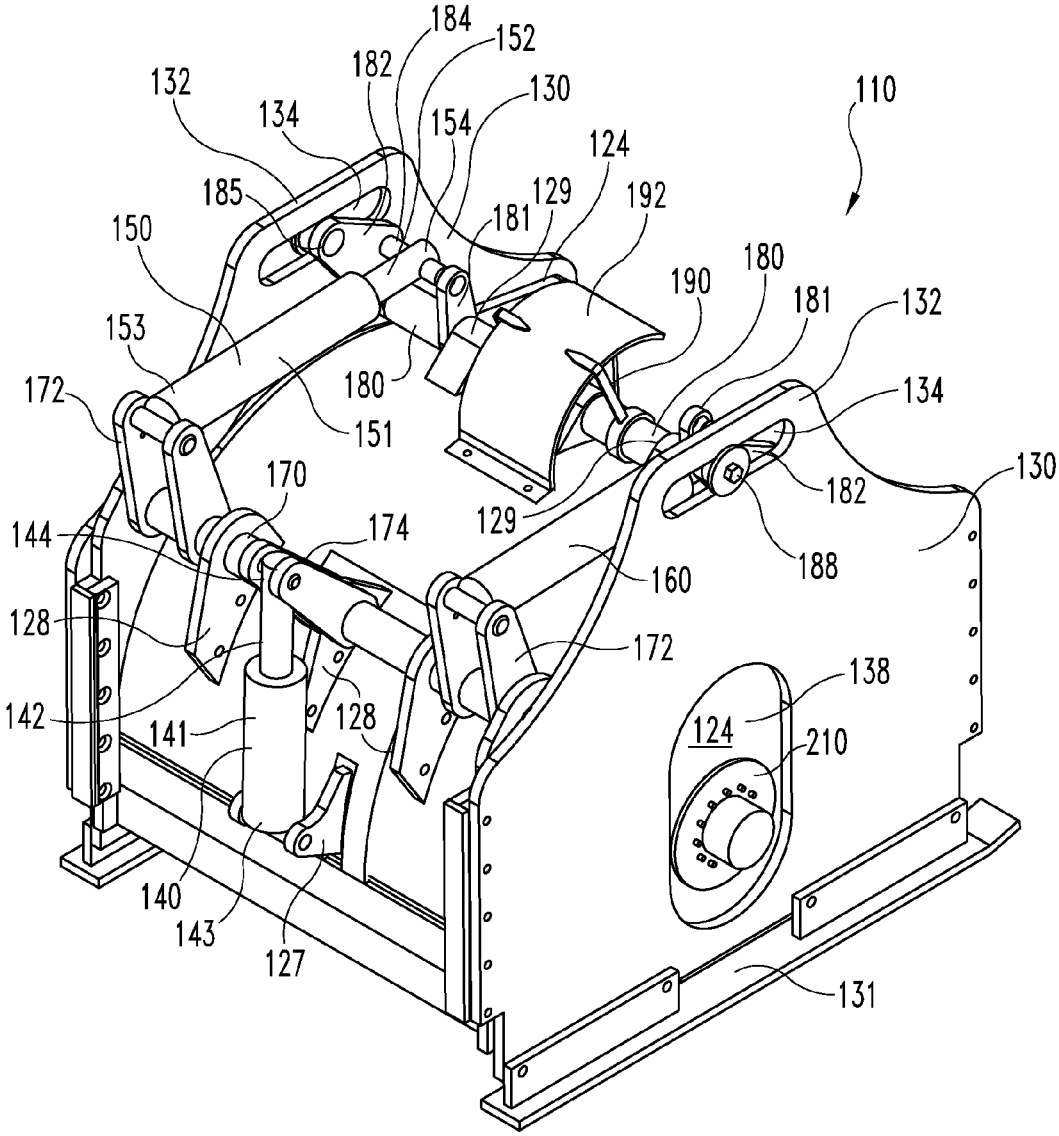
FIGS. 4 and 5 are perspective views of the planer of FIGS. 2 and 3 without the frame.
Figure 5:
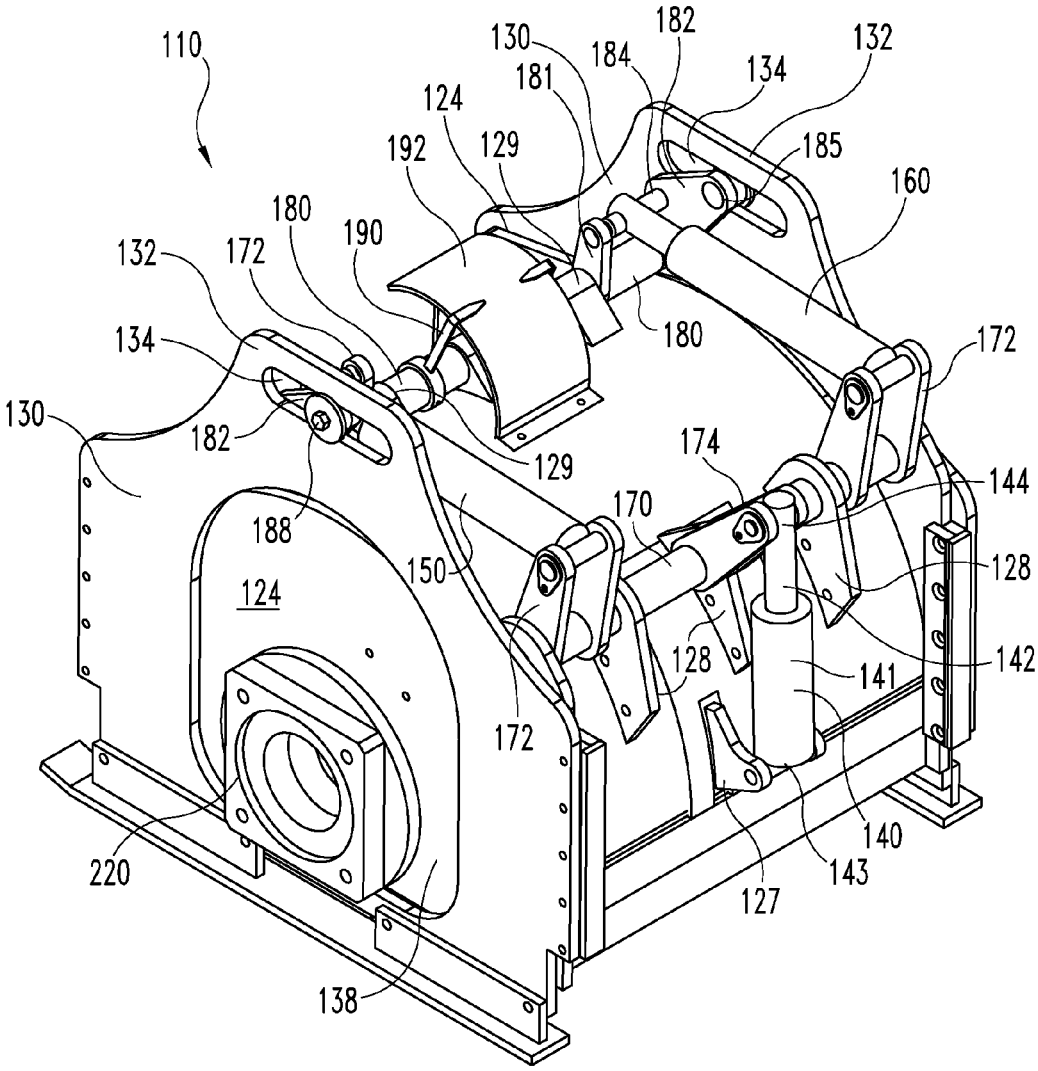

As seen without frame 30 in FIGS. 4 and 5, joint cylinder 140 includes a housing 141 and piston 142. Housing end 143 is pivotally mounted to brackets 127 on shell 122. Piston end 144 pivotally engages joint cylinder arms 174 extending from common axle 170.

In operation, an operator of planer 110 will have a control station to independently and selectively control extension or retraction of cylinders 140, 150 and 160. By extending cylinder 150, the operator causes the piston end 154 to push against bell crank 180 and arm 181 and away from housing 151, causing bell crank axle 180 and bell crank 182 to pivot. This pivot direction would be viewed as clockwise around the axis of bell crank axle 180 from the perspective of FIG. 2. The rotation of bell crank 182 will cause side wall engaging portion 185 to rise relative to bell crank axle 180, which will force bell crank pin 188 to slide and pivot within slot 134, applying an upward force to raise the corresponding side plate 130 relative to shield 122. Reciprocally, retraction of cylinder 150 will rotate bell crank 182 in the opposite direction, lowering the side plate. Cylinder 160 operates similarly with a corresponding bell crank and side plate on the opposite side of planer 110.

Joint cylinder 140 can be expanded or retracted to adjust the side plates simultaneously. Piston end 144 of cylinder 140 can be extended to push against joint cylinder arms 174 to pivot common axle 170 within brackets 128. This pivot direction would be seen as clockwise around the axis of axle 170 from the perspective of FIG. 2. The fixed angular orientation of arm pairs 172 and joint arms 174 from common axle 170 functions as offset arms of a bell crank to apply force around an angle in this arrangement. Rotation of common axle 170 causes arm pairs 172 to correspondingly pivot to push against cylinders 150 and 160. During this movement, cylinders 150 and 160 preferably are at fixed extension lengths and do not extend or retract, although they do not need to be at the same fixed length. As such, cylinders 150 and 160 each act as a fixed linkage member between an arm pair 172 and a bell crank 182. As such, rotational adjustment of common axle 170 causes corresponding equal proportional adjustment in each of bell cranks 182 and correspondingly adjust bell crank pins 188 and thus, side plates 130. Reciprocally, retraction of cylinder 140 pulls upon joint cylinder arms 174 causing common axle 170 and arm pair 172 to rotate in a counter-clockwise direction from the perspective of FIG. 2, and by linkage arrangement, rotating bell cranks 182 counter-clockwise to lower side plates 130.

A method according to the present disclosure involves grinding a surface with a planer. An example preferred method provides a hydraulic grinding assembly mounted on a frame with adjustable side plates. The side plates are selectively independently or jointly adjusted to support the grinding assembly at a desired height above the surface to be ground as the grinding assembly is moved in the direction of travel. Preferably the raising and lowering of the side plates is hydraulically controlled.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A planer with adjustable side plates, comprising:

a planer housing enclosing a grinding drum with grinding tools to be moved over a surface to be ground in a direction of travel;

a pair of side plates arranged substantially parallel to the direction of travel and mounted substantially adjacent said housing;

wherein said side plates are mechanically linked to said housing and are separately hydraulically controlled to be individually adjustably raised and lowered relative to said housing and said grinding drum.

2. The planer of claim 1 comprising a pair of sidewall adjustment cylinders, with one of said pair of cylinders linked to each of said pair of side plates, wherein said sidewall adjustment cylinders are separately hydraulically controlled to each individually adjust a corresponding side plate relative to said housing.

3. The planer of claim 2 wherein said pair of said side plates is hydraulically jointly controlled to be adjustably raised and lowered simultaneously relative to said housing.

4. The planer of claim 3 comprising a joint cylinder linked to said pair of side plates, wherein said joint cylinder is hydraulically controlled to adjustably raise and lower said side plates simultaneously relative to said housing.

5. The planer of claim 4, wherein said joint cylinder is linked to said side plates through said sidewall adjustment cylinders, such that said sidewall adjustment cylinders operate as linkage members between said joint cylinder and said side plates.

6. The planer of claim 5, wherein extension of said joint cylinder applies force to push against both of said sidewall adjustment cylinders, wherein said sidewall adjustment cylinders function as fixed length linkage members.

7. The planer of claim 6, wherein said joint cylinder is mechanically linked to said sidewall adjustment cylinders using a bell crank arrangement, such that the axis of said joint cylinder is angularly offset from the axes of said sidewall adjustment cylinders.

8. The planer of claim 2, wherein each sidewall adjustment cylinder is linked to a respective side plate via a bell crank.

9. The planer of claim 8, wherein each of said bell cranks includes an axle pivot portion pivotally mounted to said housing, a piston engagement portion pivotally mounted to an end of one of said sidewall adjustment cylinders and a side plate engaging portion linked to one of said side plates, and wherein extension of retraction of said sidewall adjustment cylinder causes said piston engagement portion and said side plate engaging portion to rotate around the axis of said axle pivot portion.

10. The planer of claim 8 comprising a joint cylinder linked between said housing and said pair of sidewall adjustment cylinders through a bell crank arrangement.

11. A planer with adjustable side plates, comprising:

a planer housing enclosing a grinding drum with grinding tools to be moved over a surface to be ground in a direction of travel and having a pair of vertical sidewalls substantially parallel to the direction of travel;

a pair of side plates arranged substantially parallel to said sidewalls; and, wherein said side plates are mechanically linked to said housing and are separately hydraulically controlled to be individually adjustably raised and lowered relative to said sidewalls and said grinding drum.

12. The planer of claim 11 comprising a pair of sidewall adjustment cylinders, with one of said pair of cylinders linked to each of said side plates, wherein said sidewall adjustment cylinders are separately hydraulically controlled to each individually adjust a corresponding side plate relative to said housing.

13. The planer of claim 12 comprising a joint cylinder linked to said pair of side plates, wherein said joint cylinder is hydraulically controlled to adjustably raise and lower said side plates simultaneously relative to said housing.

14. The planer of claim 13, wherein said joint cylinder is linked to said side plates through said sidewall adjustment cylinders, such that said sidewall adjustment cylinders operate as linkage members between said joint cylinder and said side plates.

15. The planer of claim 14, wherein said joint cylinder is mechanically linked to said sidewall adjustment cylinders using a bell crank arrangement, such that the axis of said joint cylinder is angularly offset from the axes of said sidewall adjustment cylinders.

16. The planer of claim 15, wherein each sidewall adjustment cylinder is linked to a respective side plate via a sidewall adjustment bell crank.

17. The planer of claim 16, wherein each of said sidewall adjustment bell cranks includes an axle pivot portion pivotally mounted to said housing, a piston engagement portion pivotally mounted to one of said sidewall adjustment cylinders and a side plate engaging portion linked to one of said side plates, and wherein extension of retraction of said sidewall adjustment cylinder causes said piston engagement portion and said side plate engaging portion to rotate around the axis of said axle pivot portion.

18. The planer of claim 13, wherein said housing is mounted to a support frame which supports the housing at a uniform height to control the grinding depth of said grinding drum and which is movable to move said housing and grinding drum along the surface to be ground in the direction of travel.

19. The planer of claim 18, wherein said frame is mounted to a skid-steer loader.

* * * * *